US007460132B2

(12) United States Patent
Kempf

(10) Patent No.: US 7,460,132 B2
(45) Date of Patent: Dec. 2, 2008

(54) SYSTEM AND METHOD FOR MOTION ADAPTIVE ANTI-ALIASING

(75) Inventor: Jeffrey Matthew Kempf, Dallas, TX (US)

(73) Assignee: Texas Instruments Incorporated, Dallas, TX (US)

( * ) Notice: Subject to any disclaimer, the term of this patent is extended or adjusted under 35 U.S.C. 154(b) by 532 days.

(21) Appl. No.: 11/117,150

(22) Filed: Apr. 28, 2005

(65) Prior Publication Data

US 2006/0244759 A1 Nov. 2, 2006

(51) Int. Cl.
*G09G 5/00* (2006.01)

(52) U.S. Cl. ..... 345/611; 345/428; 382/232; 382/254; 353/30

(58) Field of Classification Search ..... 345/611; 382/232, 254; 353/30
See application file for complete search history.

(56) References Cited

U.S. PATENT DOCUMENTS

| | | | | |
|---|---|---|---|---|
| 6,879,729 | B2 * | 4/2005 | Kamath et al. | 382/254 |
| 2003/0156301 | A1 | 8/2003 | Kempf et al. | |
| 2004/0170330 | A1 * | 9/2004 | Fogg | 382/232 |
| 2005/0013509 | A1 * | 1/2005 | Samadani | 382/302 |
| 2006/0044519 | A1 * | 3/2006 | Huibers et al. | 353/30 |

* cited by examiner

*Primary Examiner*—Kimbinh T Nguyen
(74) *Attorney, Agent, or Firm*—Wade J. Brady, III; Frederick J. Telecky, Jr.

(57) ABSTRACT

System and method for processing image data containing motion for display on a display device. A preferred embodiment comprises applying a filter to an input image, determining a presence of motion in the input image, and generating an output image from the input image and the filtered image based upon motion in the input image. The detection of motion in the input image permits the use of filtered image data in portions of the image containing motion, thereby taking advantage of aliasing reduction provided by the filter while allowing the use of unfiltered image data in portions not containing motion. This helps to preserve image quality since filtering softens the image.

21 Claims, 5 Drawing Sheets

SYSTEM AND METHOD FOR MOTION ADAPTIVE ANTI-ALIASING

TECHNICAL FIELD

The present invention relates generally to a system and method for image processing, and more particularly to a system and method for processing image data containing motion for display on a display device.

BACKGROUND

Through the use of image processing techniques, it can be possible to generate a high resolution image from a plurality of lower resolution images. Optical dithering allows the formation of a high-resolution image for display on a display device from two or more lower resolution images. For example, it is possible to create a high resolution image with a resolution of 1024×768 pixels from a 512×384 pixel rectilinear display device by optically moving the lower resolution display device in four half-pixel steps. The same high-resolution image can be created by moving a 1024×384 diamond display device in two half-pixel steps. The high-resolution image can therefore be formed from four quarter-resolution images or two half-resolution images.

Using optical dithering, it is possible to take a sequence of high-resolution images, such as from a high definition television feed, decompose each of the high-resolution images into multiple lower resolution images, and display the lower resolution images on the display device, simulating the high-resolution images of the high definition television feed. However, rather than using a display device that is capable of displaying the high resolution images at full resolution, the display device is only capable of display images at a half or quarter (or lower) resolution of the high resolution image.

The use of lower resolution display devices in place of a high-resolution display device can be advantageous since display devices with large pixel counts tend to be more expensive than smaller pixel count display devices. a large pixel count display device can be more expensive since they often require the use of more advanced manufacturing processes as well as having a typically lower yield rate. Additionally, adjunct circuitry needed to support the large pixel count display device is often correspondingly more expensive since they may have stricter tolerance requirements, greater data rate requirements, faster memories, and so forth. The use of optical dithering can permit the use of a lower resolution display device, while providing comparable image quality.

However, image quality can be a problem if there is motion present in an image being displayed with a display device using optical dithering techniques. The presence of motion in the image being displayed can lead to undesired artifacts when the high resolution image is being decomposed into the plurality of lower resolution images. The decomposition of the high resolution image into the plurality of lower resolution images is known as down-sampling. Down-sampling an image containing motion can lead to aliasing, which is a distortion caused by an interaction between signal frequency and sampling frequency. Too much aliasing can lead to an unacceptable image.

One technique that can be used to help remove the decomposition artifacts is to filter the high resolution image prior to the down-sampling operation. a low-pass filter, also known as an anti-aliasing filter, with appropriately selected frequency characteristics, can be used to filter the high resolution image prior to down-sampling and prevent (or reduce) the occurrence of aliasing.

One disadvantage of the prior art is that the use of the low-pass filter can result in a softening of the image in portions of the image without motion. Image softening can negate the performance gained by using high resolution images. For example, an over aggressive low-pass filter may result in an image that is not significantly better than standard definition television, even if the television is capable of displaying high definition images.

SUMMARY OF THE INVENTION

These and other problems are generally solved or circumvented, and technical advantages are generally achieved, by preferred embodiments of the present invention which provides a system and method for processing image data containing motion for display on a display device.

In accordance with a preferred embodiment of the present invention, a method for generating images for display on a display device where the display device has a lower display resolution than that of an input image is provided. The method includes applying a filter to the input image and determining the presence of motion in the input image. The method also includes generating an output image from the input image and the filtered image based upon motion in the input image.

In accordance with another preferred embodiment of the present invention, a motion adaptive anti-aliasing (MAA) circuit is provided. The MAA includes a filter coupled to a signal input. The filter is configured to eliminate high frequency components in an input signal that is provided by the input signal. The MAA also includes a motion detect unit that is coupled to the signal input. The motion detect unit is configured to generate a motion value for the input signal. Furthermore, the MAA includes an output multiplexer coupled to the filter, the motion detect unit, and the signal input. The output multiplexer is configured to proportionally combine an output of the filter and the input signal based upon the motion value.

In accordance with another preferred embodiment of the present invention, a display system is provided. The display system includes a motion adaptive anti-aliasing (MAA) circuit coupled to the signal input. The MAA circuit is configured to produce an output image from an input image provided by the signal input, where portions of the output image containing motion are filtered and portions of the output not containing motion are unfiltered. The MAA circuit is also configured to down-sample the output image into a plurality of sub-images. The display system also includes a display device coupled to the MAA circuit. The display device is configured to display each sub-image of the plurality of sub-images, where all sub-images in the plurality of sub-images is displayed within a single frame time.

An advantage of a preferred embodiment of the present invention is that the use of an anti-aliasing filter prevents (or reduces) the occurrence of aliasing in images containing motion. However, the anti-aliasing filter is applied only to portions of the image that actually contain motion, so that image softening, an undesired side-effect of the anti-aliasing filter, does not reduce the overall image quality.

a further advantage of a preferred embodiment of the present invention is that the application of the anti-aliasing filter can be scaled depending upon the amount of motion in the image. Where the image has a large amount of motion, the effects of the anti-aliasing filter can be maximized, while where the image has a small amount of motion, the effects of the anti-aliasing filter can be minimized. The scaling can be readily changed depending upon the requirements of the images being displayed, the environmental conditions of where the images are being displayed, and so forth. Furthermore, the computational requirements of the filtering remains constant, regardless of the images being displayed, the type and degree of filtering being applied, and so on.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiments disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present invention will be described with respect to preferred embodiments in a specific context, namely a digital spatial light modulator (SLM) device, namely, a digital micro-mirror device (DMD) for a display device with a display resolution that is lower than the resolution of the images that are to be displayed that makes use of optical dithering to increase the effective resolution of the display device. The invention may also be applied, however, to display devices wherein it is desired to display images with a higher resolution than what a display engine driving the display device is capable of displaying. For example, the invention may be applicable to other SLM devices, such as liquid crystal display (LCD), liquid crystal on silicon (LCoS), and so forth, as well as other non-SLM display technologies.

With reference now to FIGS. 1*a* through 1*e,* there are shown diagrams illustrating the technique of optical dithering to increase an effective display resolution of a display device, wherein pixels in the display device are arranged in a rectilinear configuration. The diagram shown in FIG. 1 a illustrates a 16-pixel array 100 arranged in a 4×4 grid. The diagram may be illustrative of a portion of the display device. The array 100 includes 16 pixels, with each pixel, such as pixel 105, being represented as a circular object. Note that for illustrative purposes, inter-pixel spacing between adjacent pixels in the array 100 may be exaggerated.

In order to increase the effective display resolution using optical dithering, it is necessary to repeatedly shift the array 100 and display the pixels in the array 100, wherein the shifts of the array 100 and displays of the pixels in the array 100 occur a requisite number of times within a specified period of time that can be equal to an amount of time wherein a full resolution image would be displayed. This specified period of time can be referred to as a frame time. Therefore, if four lower resolution images are to be used to represent a single high resolution image, then the four images must be displayed within a single frame time. Note that the array 100 may not actually be physically shifted, but a location wherein a projection of the pixels in the array 100 is shifted. For example, if light representing the pixels of the array 100 is projected onto a display screen, then the pixels' position on the display screen is shifted and not the actual pixels. In this case, a lens or mirror used to position the light is shifted.

Figure 1A:
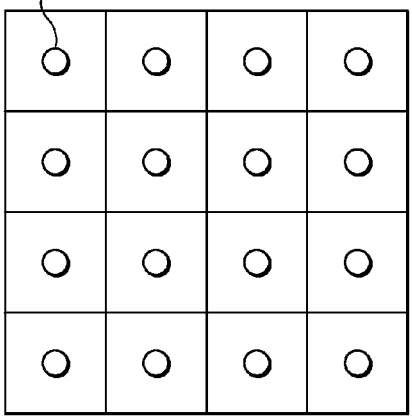
FIGS. 1*a* through 1*e* are diagrams illustrating the use of optical dithering to increase an effective display resolution of a display device, wherein pixels in the display device are arranged in a rectilinear configuration.
Figure 1B:
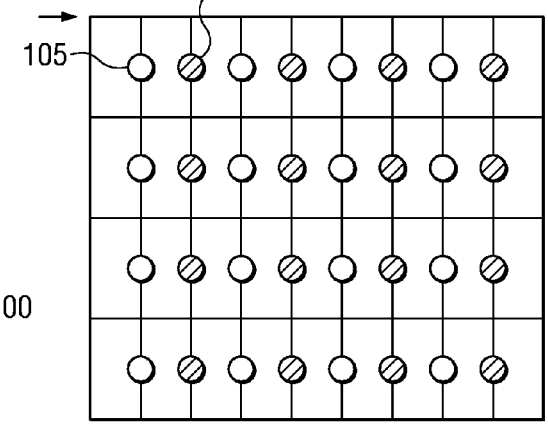
Figure 1C:
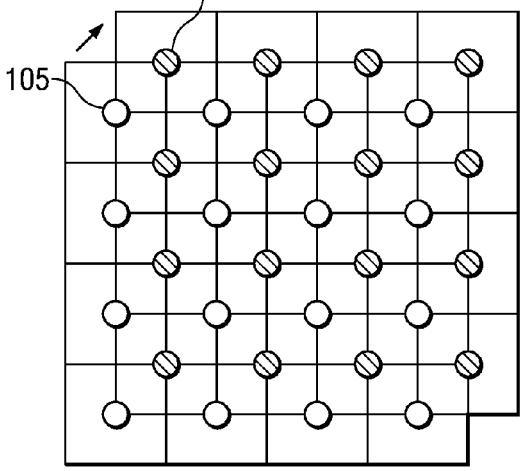
Figure 1D:
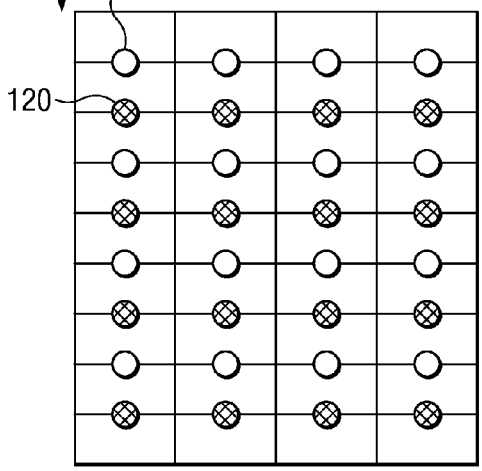
Figure 1E:
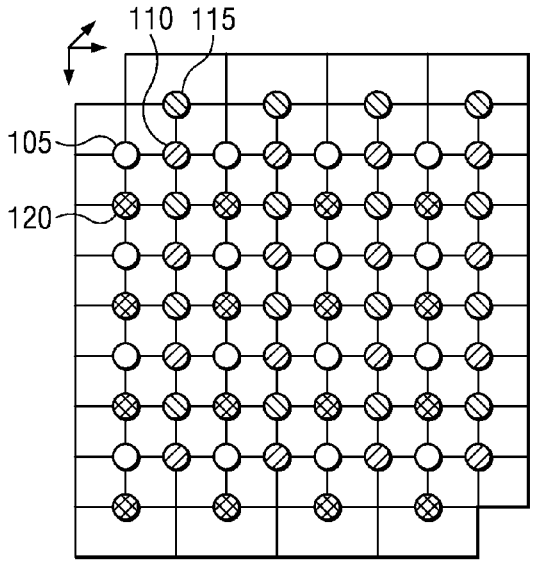

The diagram shown in FIG. 1*b* illustrates an image comprising the array 100 (as shown in FIG. 1*a*) and an image of a first shifted array. As shown in FIG. 1*b,* the first shifted array is the array 100 shifted to the right one-half pixel position. For example, the pixel 105 after being shifted one-half pixel positions to the right becomes pixel 110. Note that pixels of the array 100 are shown as unshaded, while pixels of the first shifted array are shown as being shaded. The diagram shown in FIG. 1*c* illustrates an image comprising the array 100 and an image of a second shifted array. As shown in FIG. 1*c,* the second shifted array is the array 100 shifted one-half pixel position to the right and one-half pixel position up. For example, the pixel 105 after being shifted one-half pixel position to the right and one-half pixel position up becomes pixel 115. The diagram shown in FIG. 1*d* illustrates an image comprising the array 100 and an image of a third shifted array. As shown in FIG. 1*d,* the second shifted array is the array 100 shifted one-half pixel position down. For example, the pixel 105 after being shifted one-half pixel position down becomes pixel 120. Note that the shifts of the array 100 in the right, right and up, and down directions are not necessarily unique and that other combinations of shifts applied to the array 100 are possible.

The diagram shown in FIG. 1 e illustrates a composite image containing the array 100, the first shifted array, the second shifted array, and the third shifted array. As shown in FIG. 1*e,* the composite image can be representative of what is displayed by the display device in a single frame time. The dimensions of the composite image is a full 8×7 grid with a few additional pixels on the top and bottom of the composite image, substantially double the resolution of the array 100.

Note that since pixels at an edge of an image are typically considered the least important, the additional pixels at the top and bottom of the composite image can typically be ignored without significant loss of information.

Figure 2A:
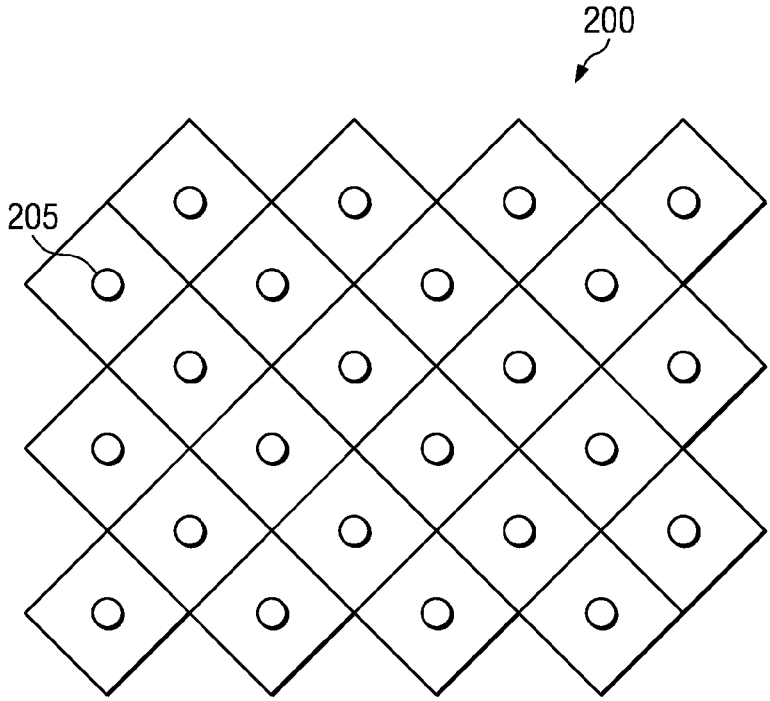
FIGS. 2*a* and 2*b* are diagrams illustrating the use of optical dithering to increase an effective display resolution of a display device, wherein pixels in the display device are arranged in a diamond configuration.
Figure 2B:
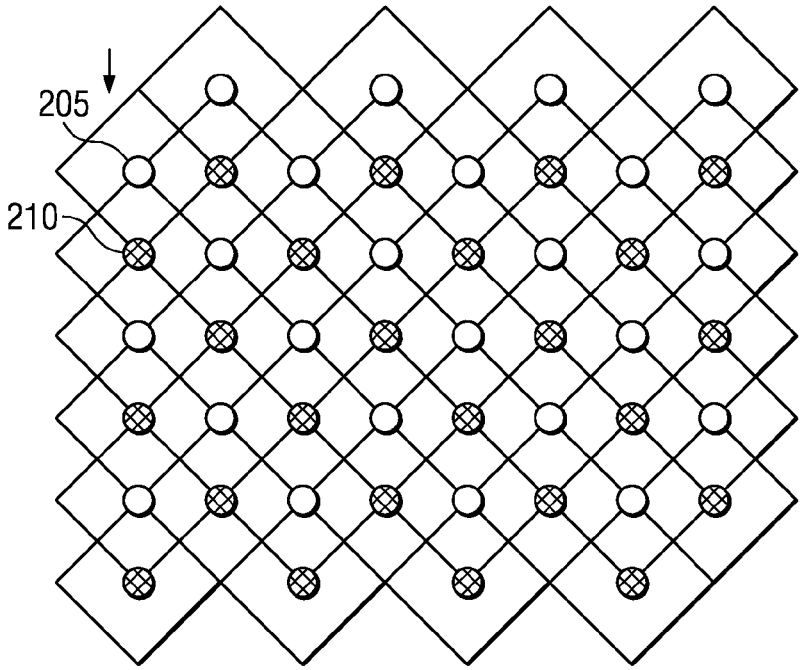

With reference now to FIGS. 2*a* and 2*b*, there are shown diagrams illustrating the technique of optical dithering to increase the effective display resolution of a display device, wherein pixels in the display device are arranged in a diamond configuration. The diagram shown in FIG. 2*a* illustrates a 24-pixel array 200 arranged in an 8×3 diamond configuration. The array 200 may a portion of a display device with a larger number of pixels. Each pixel in the array 200, such as pixel 205, is represented as a circular object. Note that for illustrative purposes, inter-pixel spacing between adjacent pixels in the array 100 may be exaggerated.

The diagram shown in FIG. 2*b* illustrates an image comprising the array 200 (as shown in FIG. 2*a*) and an image of a shifted array. As shown in FIG. 2*b*, the shifted array is the array 200 shifted down one-half pixel position. For example, the pixel 205 after being shifted one-half pixel down becomes pixel 210. Note that the shift of the array 200 in the downward direction is not necessarily unique and that other shifts applied to the array 200 are possible.

a composite image containing the array 200 and the shifted array, such as shown in FIG. 2*b*, can be representative of an image displayed by the display device in a single frame time. The dimensions of the composite image is a full 8×6 diamond configuration, double the resolution of the array 200.

As discussed previously, the down-sampling of a high-resolution image into a plurality of lower resolution images for display can result in aliasing if the high-resolution image contains motion. If significant aliasing results from the down-sampling operation, image quality can degrade to a point of viewer dissatisfaction.

Figure 3A:
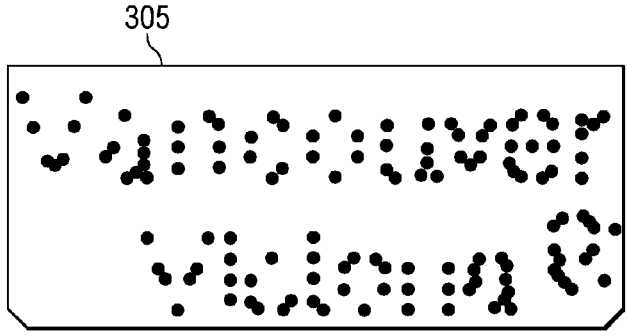
FIGS. 3*a* and 3*b* are diagrams illustrating the effects of aliasing on image quality.
Figure 3B:
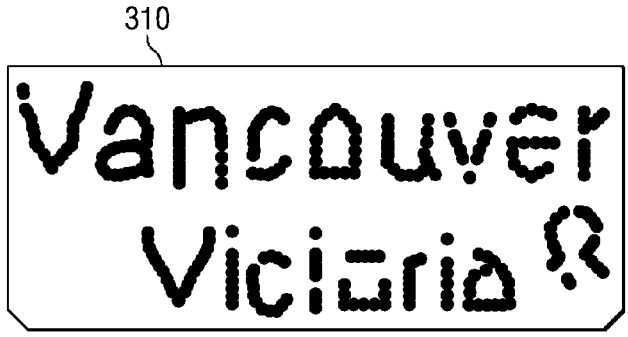

With reference now to FIGS. 3*a* and 3*b*, there are shown diagrams illustrating the impact of aliasing on image quality and the effectiveness of an anti-aliasing filter on reducing aliasing. The diagram shown in FIG. 3*a* illustrates the impact of aliasing on image quality. Shown in FIG. 3*a* is text 305 from a high-resolution image, wherein the text 305 is in motion. For example, the text 305 may be a part of a scrolling text display used to provide information. The down-sampling of the high-resolution image resulting in aliasing, which manifests itself in distorted lettering of the text 305. Depending upon the degree of aliasing, the distortion may be sufficient to prevent reading of the text 305. As shown in FIG. 3*a*, the text 305 has some letters with portions missing while other letters are distorted.

The diagram shown in FIG. 3*b* illustrates an image (generated from the same image used in the diagram shown in FIG. 3*a*) where an anti-aliasing filter was applied prior to the down-sampling operation. Instead of having distorted lettering in the text 305, the image contains text 310 that is clearly legible.

While the use of an anti-aliasing filter is an effective way to eliminate (or reduce) aliasing during the down-sampling of a high-resolution image, its use can soften an image. If an image is made too soft, image quality gains by using high-resolution images can be lost. Therefore, to minimize softening of the image, the anti-aliasing filter should be used where needed, in portions of the high-resolution image where there is motion, and not over the entire image.

Figure 4A:
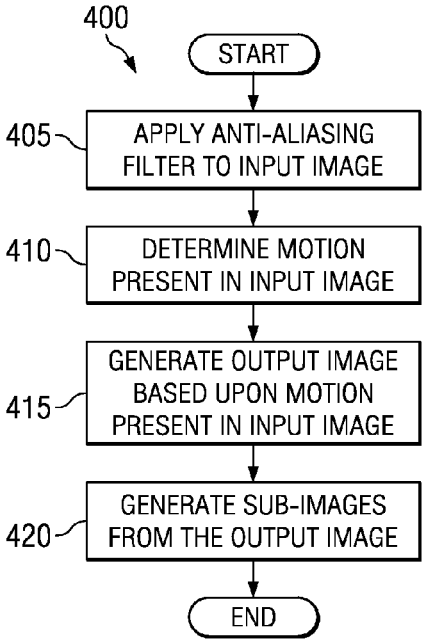
FIGS. 4*a* and 4*b* are diagrams illustrating sequences of events in the generation of an image for display with application of an anti-aliasing filter based upon the presence of motion in the image, according to a preferred embodiment of the present invention.
Figure 4B:
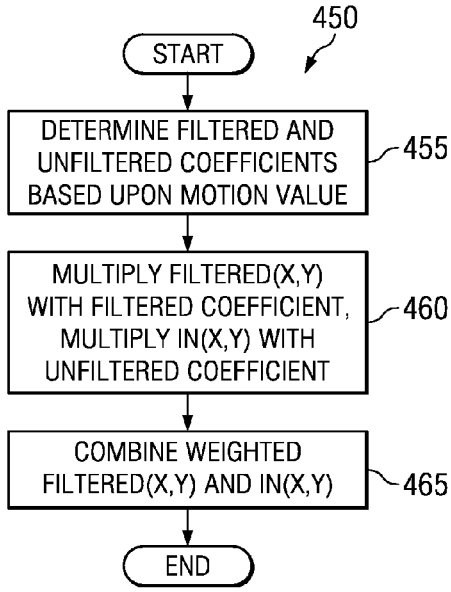

With reference now to FIGS. 4*a* and 4*b*, there are shown flow diagrams illustrating sequences of events in the generation of an image for display with the application of an anti-aliasing filter to the image based upon the presence of motion in the image, according to a preferred embodiment of the present invention. According to a preferred embodiment of the present invention, a sequence of events 400 can be representative of actions taken in the generation of an output image from an input image wherein an anti-aliasing filter can be applied to portions of the input image containing motion. The sequence of events 400 can process the input image in parallel to generate the output image. The parallel processing can yield the output image in relatively constant time, independent of the amount of motion present in the input image. Therefore, even if the input image happens to have a lot of motion, the output image will be generated in about the same amount of time as if the input image has very little (or no) motion.

Figure 5A:
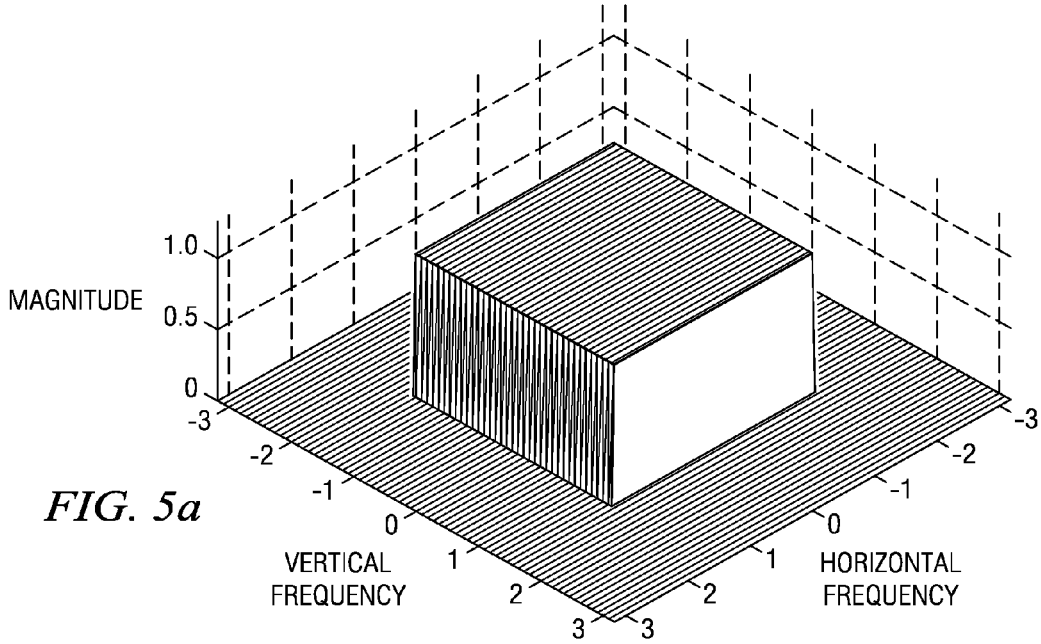
FIGS. 5*a* and 5*b* are diagrams illustrating frequency responses of exemplary anti-aliasing filters, according to a preferred embodiment of the present invention.
Figure 5B:
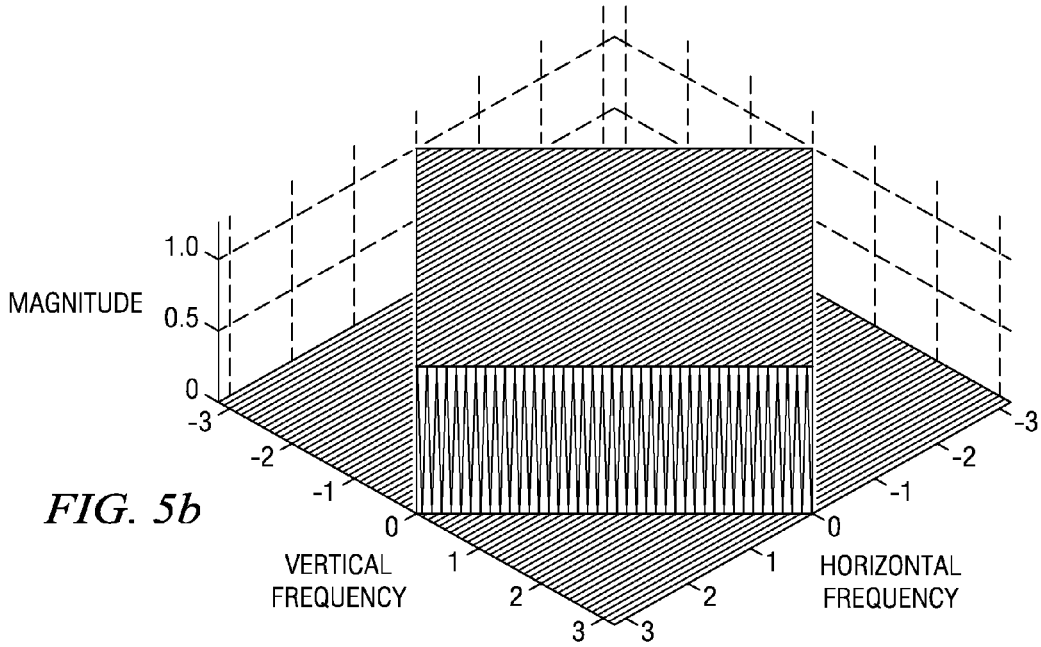

The sequence of events 400 can begin with the application of the anti-aliasing filter to the input image (block 405). The application of the anti-aliasing filter produces a filtered image from the input image. The frequency characteristics of the anti-aliasing filter used to filter the input image can differ depending upon factors such as degree of anti-aliasing desired, topology of the display device (such as rectilinear or diamond configuration), performance capabilities of hardware used to implement the anti-aliasing filter, and so forth. Referencing now to FIGS. 5*a* and 5*b*, there are shown three-dimensional plots of frequency responses for exemplary four-way movement and two-way movement anti-aliasing filters, according to a preferred embodiment of the present invention. The three-dimensional plot shown in FIG. 5*a* is for an exemplary four-way movement anti-aliasing filter for use with a rectilinear display device and the three-dimensional plot shown in FIG. 5*b* is for an exemplary two-way movement anti-aliasing filter for use with a diamond configuration display device.

With reference back to FIG. 4*a*, occurring at substantially the same time as the filtering of the input image by the anti-aliasing filter (block 405), the input image can also be provided to a motion detection algorithm to determine the presence of motion in the input image (block 410). According to a preferred embodiment of the present invention, the motion detection algorithm processes the input image and determines if there is motion present in the input image. The motion detection algorithm computes a numerical value for each pixel in the input image that can be representative of the motion in the pixel. Refer to co-pending and co-assigned patent application, Ser. No. 10/334,555, entitled "Content-Dependent Scan Rate Converter with Adaptive Noise Reduction," filed Dec. 31, 2002, which is incorporated herein by reference, for a detailed discussion of the motion detection algorithm.

Using the numerical value representing motion present in each pixel of the input image, an output image can be generated from the input image and the filtered image (block 415). Note that for each pixel in the output image, pixel information from the input image and the filtered image can be used. According to a preferred embodiment of the present invention, based upon the numerical value representing motion information, the input image and the filtered image can be combined in specific proportions dependent upon the numerical value to form the output image. For example, if the numerical value indicates a large amount of motion in the pixel, then the pixel in the output image will be generated mostly from the filtered image pixel, while if the numerical value indicates a small amount of motion in the pixel, then the pixel in the output image will be generated mostly from the input image pixel. After the output image has been generated (block 415), the output image can be down-sampled into sub-frames (block 420) so that the output image can be displayed on a display device.

The flow diagram shown in FIG. 4*b* illustrates a sequence of events 450 in the generation of an output image from the input image and the filtered image and using motion information provided by a motion detection algorithm. The sequence of events 450 illustrated in FIG. 4*b* can be an exemplary implementation of block 415 of FIG. 4*a*. The sequence of events 450 can begin with a determination of a pair of coefficients based upon a motion value provided by the motion detection algorithm (block 455). The pair of coefficients can be used as weights in the generation of the output image. The pair of coefficients, a filtered coefficient and an unfiltered coefficient, can be used to weigh the filtered image pixel and the input image pixel, respectively. After determining the pair of coefficients, the filtered coefficient and the unfiltered coefficient can be multiplied with the filtered image pixel and the input image pixel (block 460), with the filtered coefficient being multiplied with the filtered image pixel and the unfiltered coefficient being multiplied with the input image pixel. After multiplication, the two products can be added to produce an output image pixel (block 465).

Figure 6:
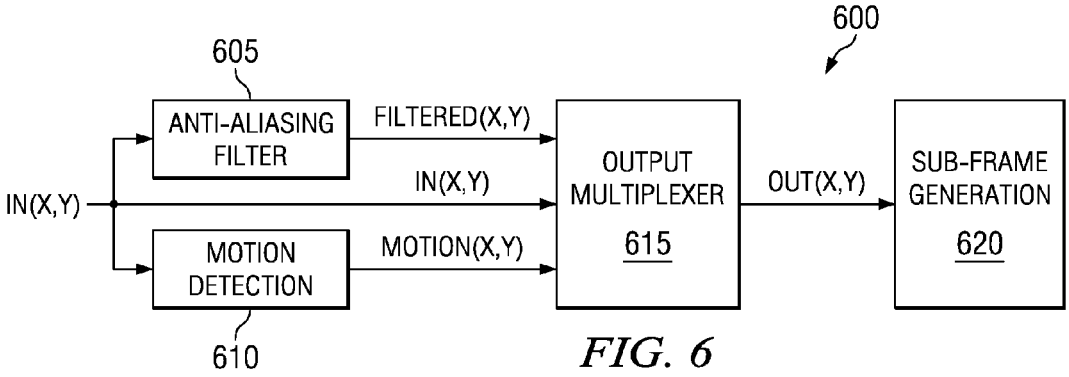
FIG. 6 is a diagram illustrating a motion adaptive anti-aliasing engine, according to a preferred embodiment of the present invention.

With reference now to FIG. 6, there is shown a diagram illustrating a motion adaptive anti-aliasing engine (MAA) 600, according to a preferred embodiment of the present invention. The MAA 600 can be used to produce a plurality of low-resolution images from a stream of high-resolution images by performing down-sampling of the high-resolution images. The MAA 600 also anti-alias filters the high-resolution images to eliminate (or reduce) the occurrence of aliasing, which would degrade image quality. Furthermore, the MAA 600 adaptively applies the anti-alias filter to minimize softening of the high-resolution images, which would also degrade image quality. The plurality of low resolution images can then be used by a display device, wherein the display device does not have the capability to display the high-resolution images, to simulate the display of the high-resolution images through the use of optical dithering.

The MAA 600 includes an anti-aliasing filter 605, which can be a software or a hardware implementation of the filter. Alternatively, the anti-aliasing filter 605 can be implemented as a custom designed integrated circuit. The anti-aliasing filter 605 is coupled to a signal input IN(X,Y), which can be a digital signal stream of pixels in the high-resolution images, and may be a high-definition television signal feed, an up-sampled output from a DVD player, a cable or satellite decoder box, or so forth. Output of the anti-aliasing filter 605 can be referred to as FILTERED(X,Y). In addition to being provided to the anti-aliasing filter 605, the signal input IN(X, Y) can also be provided to a motion detection unit 610. The motion detection unit 6 1 0 can be a software or a hardware implementation of a motion detection algorithm, such as the motion detection algorithm discussed previously. Alternatively, the motion detection unit 610 can be implemented as a custom designed integrated circuit. Output from the motion detection unit 610 can be referred to as MOTION(X,Y).

Output from anti-aliasing filter 605 (FILTERED(X,Y)) and output from the motion detection unit 610 (MOTION(X, Y)), along with the signal input (IN(X,Y)), may be coupled to an output multiplexer unit 615. The output multiplexer unit 615 can make use of the output from the motion detection unit 610 (MOTION(X,Y)) to combine the output of the anti-aliasing filter 605 (FILTERED(X,Y)) with the signal input (IN(X, Y)). The combining performed by the output multiplexer unit 615, for the most part, is not a simple equal weight combining of the FILTERED(X,Y) and IN(X,Y) values. Rather, depending upon the value of MOTION(X,Y), the output multiplexer unit 615 applies a weight to both the FILTERED(X,Y) and the IN(X,Y) and then combines the weighted values. Output from the output multiplexer unit 615 can be referred to as OUT(X, Y) and may be thought of as a version of the input image with the anti-aliasing filter applied to portions of the input image containing motion.

The output of the output multiplexer unit 615 (OUT(X,Y)) can be provided to a sub-frame generation unit 620, which can be responsible for generating low resolution images from the high-resolution images provided by the output multiplexer unit 615. For example, depending upon the topology of the pixels in the display device (such as rectilinear or diamond configuration), the sub-frame generation unit 620 can produce either four low-resolution images (rectilinear display device) or two low-resolution images (diamond configuration display device) that can be displayed by the display device to simulate the full high-resolution image.

Figure 7:
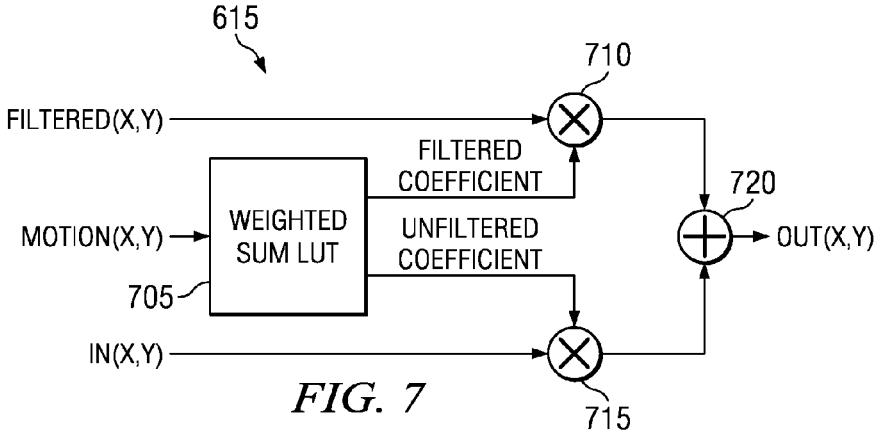
FIG. 7 is a diagram illustrating a detailed view of an output multiplexer, according to a preferred embodiment of the present invention.

With reference now to FIG. 7, there is shown a diagram illustrating an exemplary output multiplexer unit 615, according to a preferred embodiment of the present invention. The exemplary output multiplexer unit 615 includes a weighted sum look-up table (LUT) 705 that can have as an input, the output from the motion detection unit 610 (FIG. 6). The MOTION(X,Y) can be used as an index into the LUT 705 and can be used to retrieve the pair of coefficients, the filtered coefficient and the unfiltered coefficient. The LUT 705 can have as many indices as there are possible values of MOTION (X,Y) and for each index, the LUT 705 can store the pair of coefficients. For example, if there are 32 possible values of MOTION(X,Y), then the LUT 705 can be viewed as a table with 32 rows and two columns, with each column used to store one value of the pair of coefficients. The LUT 705 can be a portion of memory in a larger memory that can be used for other purposes or the LUT 705 may be implemented from a specially dedicated memory, used only for the LUT 705. a pair of multipliers 710 and 715 can be used to multiply the FILTERED(X,Y) and IN(X,Y) with the filtered coefficient and the unfiltered coefficient, respectively. An adder 720 can combine the products of the FILTERED(X,Y) and IN(X,Y) with the pair of coefficients and produce the OUT(X,Y) value. Note that the pair of multipliers 710 and 715 and the adder 720 can be implemented in either software or hardware, or alternatively, they can be a part of a custom designed integrated circuit.

Figure 8:
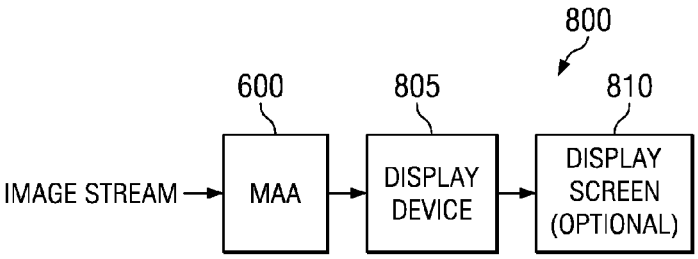
FIG. 8 is a diagram illustrating a display system, according to a preferred embodiment of the present invention.

With reference now to FIG. 8, there is shown a diagram illustrating a display 800, according to a preferred embodiment of the present invention. The display 800 can be used to display images from a high-definition television source, a DVD player, satellite or cable television, and so forth. The display 800 can include the MAA 600, which can be coupled to an image source providing an image stream. The MAA 600 can provide a series of low-resolution images that can be displayed by a display device 805, wherein the display device 805 can make use of optical dithering to effectively increase the resolution of the images that it is displaying. If the display device 805 is a direct view display device, then the images can be viewed directly from the display device 805. The display device 805 may be a digital spatial light modulator (SLM) system, such as a digital micromirror device (DMD), liquid crystal display (LCD) device, liquid crystal on silicon (LCoS), and so forth. However, if the display device 805 is not a direct view display device, then the display 800 may include a display screen 810. The display device 805 can project the images onto the display screen 810, where it can be viewed.

Although the present invention and its advantages have been described in detail, it should be understood that various changes, substitutions and alterations can be made herein without departing from the spirit and scope of the invention as defined by the appended claims.

Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for generating images for display on a display device, the method comprising:

applying a filter to an input image;

determining a presence of motion in the input image;

generating an output image by combining the input image and the filtered image proportional to an amount of the motion in the input image; and generating sub-images from the output image, wherein the sub-images have a lower resolution than the output image.

2. The method of claim 1, wherein the output image is down-sampled to form the sub-images.

3. The method of claim 1, wherein a number of the sub-images is dependent upon an arrangement of pixels in the display device.

4. The method of claim 1, wherein each sub-image has a resolution that is less than or equal to a display resolution of the display device.

5. The method of claim 1, wherein the determining of the presence of motion comprises computing a motion value for each pixel in the input image.

6. The method of claim 5, wherein the generating of the output image comprises:

computing a filtered coefficient and an unfiltered coefficient for each pixel in the input image based upon the pixel's motion value;

multiplying the pixel with the unfiltered coefficient;

multiplying a corresponding pixel in the filtered image with the filtered coefficient; and combining the results of the multiplyings to produce a pixel in the output image.

7. The method of claim 6, wherein the filtered coefficient and the unfiltered coefficient are stored in a look-up table.

8. The method of claim 1, wherein the filter is an anti-aliasing filter.

9. A motion adaptive anti-aliasing (MAA) circuit comprising:

a filter coupled to a signal input, the filter configured to eliminate high frequency components in an input signal provided by the signal input;

a motion detect unit coupled to the signal input, the motion detect unit configured to generate a motion value for the input signal;

an output multiplexer coupled to the filter, the motion detect unit, and the signal input, the output multiplexer configured to proportionally combine an output of the filter and the input signal based upon the motion value to generate an output image; and a sub-frame generation unit coupled to the output multiplexer, the sub-frame generation unit configured to down-sample the output image into a plurality of sub-images, wherein each sub-image has a lower resolution than the output image.

10. The MAA circuit of claim 9, wherein the input signal is a series of input images, wherein the filter, the motion detect unit, and the output multiplexer operate on pixels of information, and wherein for each pixel in an input image, the output multiplexer computes a filtered coefficient and an unfiltered coefficient based upon the pixel's motion value, and multiplies the pixel with the unfiltered coefficient and multiplies a corresponding filtered pixel with the filtered coefficient and combines the results of the multiplies to produce a pixel in the output image.

11. The MAA circuit of claim 10, wherein the output multiplexer comprises:

a memory to store a filtered coefficient and an unfiltered coefficient for each of a plurality of motion values;

a first multiplier coupled to the memory and the filter, the first multiplier to multiply the corresponding filtered pixel with the filtered coefficient;

a second multiplier coupled to the memory and the signal input, the second multiplier to multiply the pixel with the unfiltered coefficient; and a combiner coupled to the first multiplier and the second multiplier, the combiner to combine the results of the first multiply and the second multiply.

12. The MAA circuit of claim 11, wherein the filtered coefficients and the unfiltered coefficients are stored in a look-up table that is indexed by the motion value.

13. The MAA circuit of claim 9 wherein the resolution of each sub-image is less-than or equal to a display resolution of a display device coupled to the MAA circuit.

14. The MAA circuit of claim 9, wherein the filter is an anti-aliasing filter.

15. A display system comprising:

a motion adaptive anti-aliasing (MAA) circuit coupled to a signal input, the MAA circuit configured to produce an output image from an input image provided by the signal input, wherein portions of the output image containing motion are filtered and portions of the output image not containing motion are unfiltered, and configured to down-sample the output image into a plurality of sub-images, wherein each sub-image has a lower resolution than the output image; and a display device coupled to the MAA circuit, the display device configured to display each sub-image of the plurality of sub-images, wherein the plurality of sub-images are displayed within a single frame time.

16. The display system of claim 15 further comprising a display screen coupled to the display device, the display screen to permit viewing of projected sub-images.

17. The display system of claim 15, wherein the MAA circuit comprises:

a filter coupled to the signal input, the filter configured to eliminate high frequency components in the input image;

a motion detect unit coupled to the signal input, the motion detect unit configured to generate a motion value for the input image;

an output multiplexer coupled to the filter, the motion detect unit, and the signal input, the output multiplexer configured to proportionally combine an output of the filter and the input signal based upon the motion value to produce the output image; and a sub-frame generation unit coupled to the output multiplexer, the sub-frame generation unit configured to perform the down-sample of the output image into the plurality of sub-images.

18. The display system of claim 15, wherein the display device is a digital micromirror device.

19. The display system of claim 15, wherein the display device uses pixels arranged in a diamond configuration, and wherein each output image is down-sampled into two sub-images.

20. The display system of claim 15, wherein the display device uses pixels arranged in a rectilinear configuration, and wherein each output image is down-sampled into four sub-images.

21. The method of claim 1, wherein the display device has a lower resolution than a resolution of the input image.

* * * * *